US011008212B2

(12) United States Patent
McPhaul

(10) Patent No.: US 11,008,212 B2
(45) Date of Patent: May 18, 2021

(54) SADDLES WITH ECCENTRIC OR INTERCHANGEABLE SADDLE HORN ASSEMBLIES

(71) Applicant: Adrian E. McPhaul, Fillmore, UT (US)

(72) Inventor: Adrian E. McPhaul, Fillmore, UT (US)

( * ) Notice: Subject to any disclaimer, the term of this patent is extended or adjusted under 35 U.S.C. 154(b) by 114 days.

(21) Appl. No.: 15/723,942

(22) Filed: Oct. 3, 2017

(65) Prior Publication Data

US 2018/0093880 A1 Apr. 5, 2018

Related U.S. Application Data

(60) Provisional application No. 62/404,543, filed on Oct. 5, 2016.

(51) Int. Cl.
*B68C 1/02* (2006.01)
*B68C 1/04* (2006.01)

(52) U.S. Cl.
CPC ..... *B68C 1/04* (2013.01); *B68C 1/02* (2013.01); *B68C 1/025* (2013.01); *B68C 2001/046* (2013.01)

(58) Field of Classification Search
CPC .... B68C 1/00; B68C 1/02; B68C 1/04; B68C 2001/044; B68C 1/06; B68C 1/025; B68C 2001/046
See application file for complete search history.

(56) References Cited

U.S. PATENT DOCUMENTS 2,037,275 A * 4/1936 Senderman ..... B68C 1/025 54/44.3
2,451,651 A 10/1948 Baldwin
3,088,259 A * 5/1963 Nuzzo ..... B68C 1/025 54/44.7
3,153,887 A * 10/1964 Bohlin ..... B68C 1/02 54/46.2
3,293,828 A * 12/1966 Hessler ..... B68C 1/025 54/44.7
3,388,530 A * 6/1968 Parker ..... B68C 1/02 54/44.1
3,712,024 A 1/1973 Nankivell
5,101,614 A * 4/1992 Bozanich ..... B68C 1/025 54/44.1
5,651,240 A * 7/1997 Tompkins ..... B68C 1/02 54/44.1
8,397,477 B2 3/2013 Stephens
(Continued)

FOREIGN PATENT DOCUMENTS

DE 102009055705 * 6/2011 ..... B68C 1/00
FR 2584697 A1 * 1/1987 ..... B68C 1/02
(Continued)

*Primary Examiner* — Son T Nguyen
(74) *Attorney, Agent, or Firm* — Bretton L. Crockett; TechLaw Ventures, PLLC

(57) ABSTRACT

Specialized saddles and components for specialized saddles. In some embodiments, the saddles may include one or more saddle horns that may be placed nearer one side of the saddle than the other. In certain embodiments, the saddle horn may be detachable, allowing different saddle horns to be used with a single saddle assembly or for multiple positions on a single saddle assembly where the saddle horn may be located for use.

18 Claims, 3 Drawing Sheets

(56) References Cited

U.S. PATENT DOCUMENTS

| | | | | |
|---|---|---|---|---|
| 2006/0137300 | A1* | 6/2006 | Van Scoyk | B68C 1/00 54/44.1 |
| 2011/0067365 | A1* | 3/2011 | Stephens | A63B 69/0068 54/44.1 |

FOREIGN PATENT DOCUMENTS

| | | | | |
|---|---|---|---|---|
| FR | 2669914 | A1 * | 6/1992 | B68C 1/02 |
| FR | 2698861 | A1 * | 6/1994 | B68C 1/06 |
| FR | 2850371 | A1 * | 7/2004 | B68C 1/025 |
| WO | WO-9739978 | A1 * | 10/1997 | B68C 1/002 |

* cited by examiner

SADDLES WITH ECCENTRIC OR INTERCHANGEABLE SADDLE HORN ASSEMBLIES

CROSS-REFERENCE TO RELATED APPLICATION

This application claims the benefit of U.S. Provisional Application No. 62/404,543, filed Oct. 5, 2016, the disclosure of which is incorporated herein by reference in its entirety.

TECHNICAL FIELD

This invention relates to saddles, especially western style saddles used in riding, roping, and competitions.

BACKGROUND

A standard horseback riding saddle, especially a "western" style saddle used for working horses and in rodeos and other competitions, is typically constructed as a solid framework known as a saddle tree which is then covered with leather or another material. A typical tree may include two bars and cantle and a fork. A saddle horn traditionally placed towards the front of the saddle before the rider, as a permanent fixture at the latitudinal center of the fork. The saddle horn is reinforced and strongly secured to the saddle frame, allowing it to be used to tie off a rope that is used for catching and restraining a roped animal, or as a handgrip for mounting or when needed for balance while riding.

Different styles of saddle horns may be intended for use in different situations. For example, a roping saddle may have a horn with a rubber coated stem for dallying, while other horns may be designed for use as handles.

A saddle which had an eccentrically placed horn system that reduced the time needed for a user to dally would be an improvement in the art. Similarly, a saddle that included an interchangeable horn system allowing for an eccentrically placed horn and/or for the use of different horn assemblies would be a further improvement in the art.

SUMMARY

The present disclosure is directed to specialized saddles. In some embodiments, the saddles may include one or more saddle horns that may be placed nearer one side of the saddle than the other. In certain embodiments, the saddle horn may be detachable, allowing different saddle horns to be used with a single saddle assembly or for multiple positions on a single saddle assembly where the saddle horn may be located for use.

DESCRIPTION OF THE DRAWINGS

It will be appreciated by those of ordinary skill in the art that the various drawings are for illustrative purposes only. The nature of the present disclosure, as well as other embodiments in accordance with this disclosure, may be more clearly understood by reference to the following detailed description, to the appended claims, and to the several drawings.

DETAILED DESCRIPTION

The present disclosure relates to apparatus, systems and methods for building and using horse riding saddles. It will be appreciated by those skilled in the art that the embodiments herein described, while illustrative, are not intended to so limit this disclosure or the scope of the appended claims. Those skilled in the art will also understand that various combinations or modifications of the embodiments presented herein can be made without departing from the scope of this disclosure. All such alternate embodiments are within the scope of the present disclosure.

Figure 1:
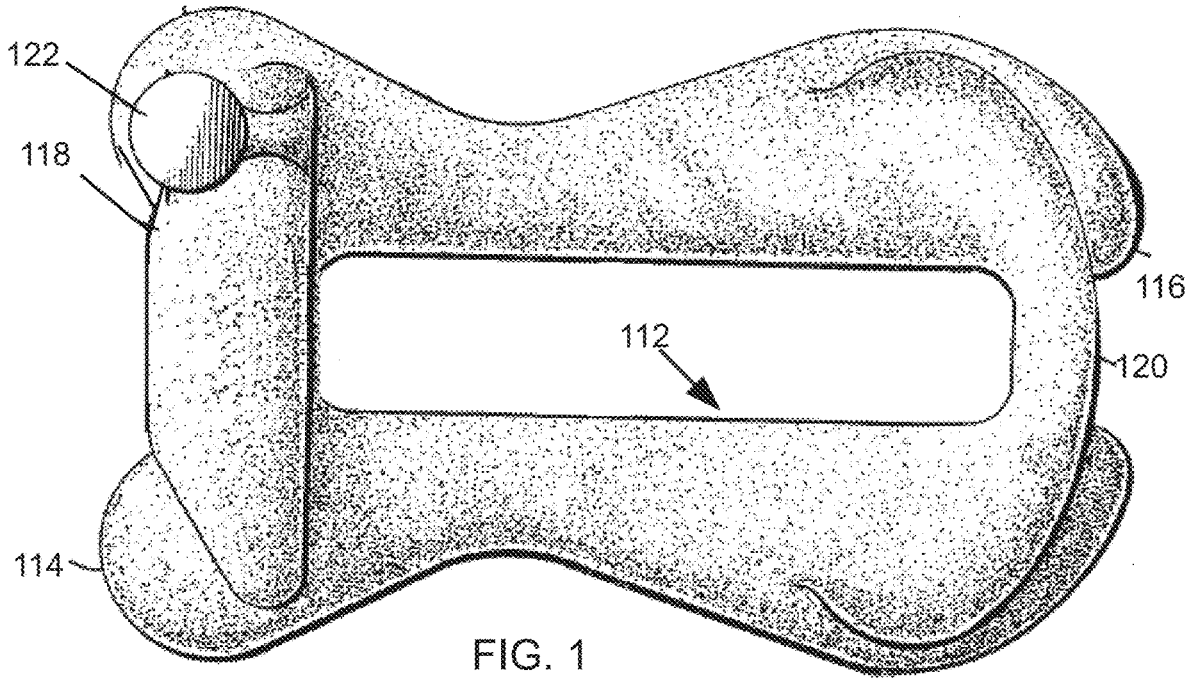
FIG. 1 depicts a top view of a first saddle tree for constructing a saddle in accordance with the present disclosure.
Figure 2:
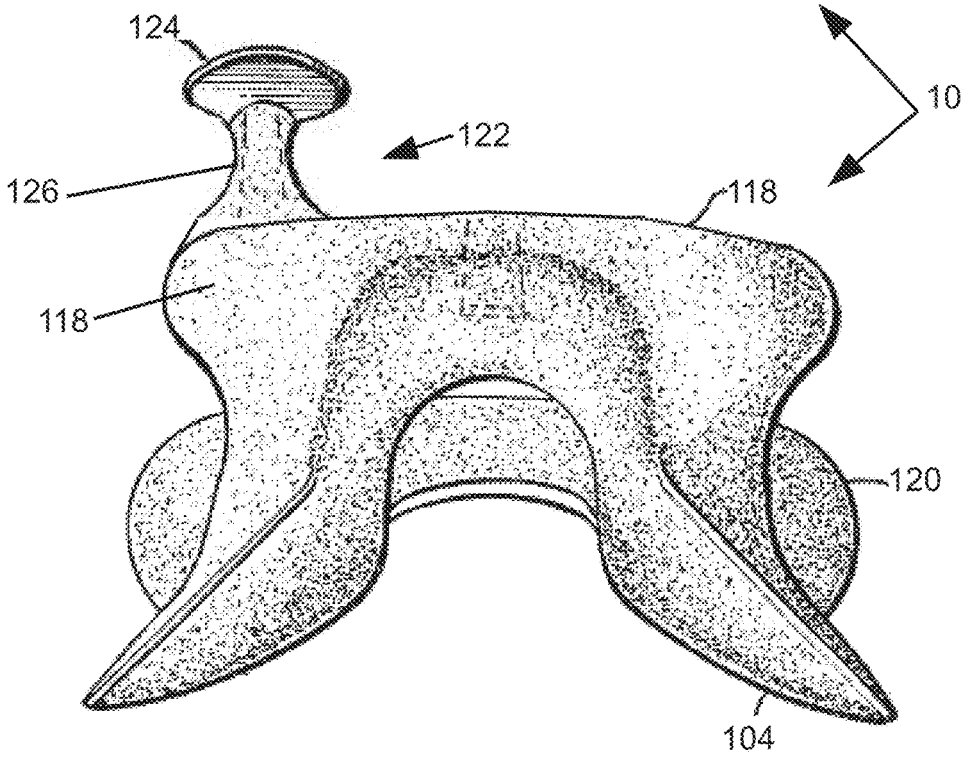
FIG. 2 is front view of the saddle tree of FIG. 1.

Turning to FIGS. 1 and 2, a saddle tree 10 for constructing a saddle in accordance with the present disclosure. The depicted saddle tree 10 may be constructed from injection molding of a suitable plastic or other material. U.S. Pat. No. 3,712,024 to Nankivell, the disclosure of which is incorporated herein by reference, discloses methods for constructing saddle trees in this manner. However, it will be appreciated that saddle trees constructed from other materials including wood, metal, fiberglass, carbon fiber, etc. may be used in accordance with the present disclosure.

The depicted saddle tree includes a seat portion 112, a left bar 114, a right bar 116, a pommel or fork 118, a cantle 120 and a saddle horn 122.

As depicted, the saddle horn 122 that is placed nearer one side of the saddle than the other. In the depicted embodiment, it is placed towards the right hand side of a mounted user, but it will be appreciated that in other embodiments, it may be placed on the left hand side. This may be useful for a user who is right or left handed or for use in a roping competition.

The saddle horn has an enlarged head 124 and stem portion 126 that rises from the fork 118. In use for roping, a rope may be secured around the stem portion 126 under the head 124. The horn 122 may include an internal framework, such as a metal frame that attaches to an anchoring structure, such as plates, webs, or studs, in the pommel 118 to provide sufficient strength for use. It will be appreciated that other embodiments may feature multiple horns 122 disposed on opposite sides, or having differing offsets.

By positioning the saddle horn 122 near one latitudinal side of the saddle pommel 118, the efficiency and utility of the horn may be enhanced for particular applications. In one illustrative example, while a single offset horn 122 may be harder to use from the opposite side, the distance needed for a user to reach and dally a rope on the horn from the side of the saddle where the horn is disposed is reduced. This can allow a user to dally with a shorter motion and in a shorter time. Additionally, it can allow easier use of the horn 122 as a handle for mounting.

Figure 3:
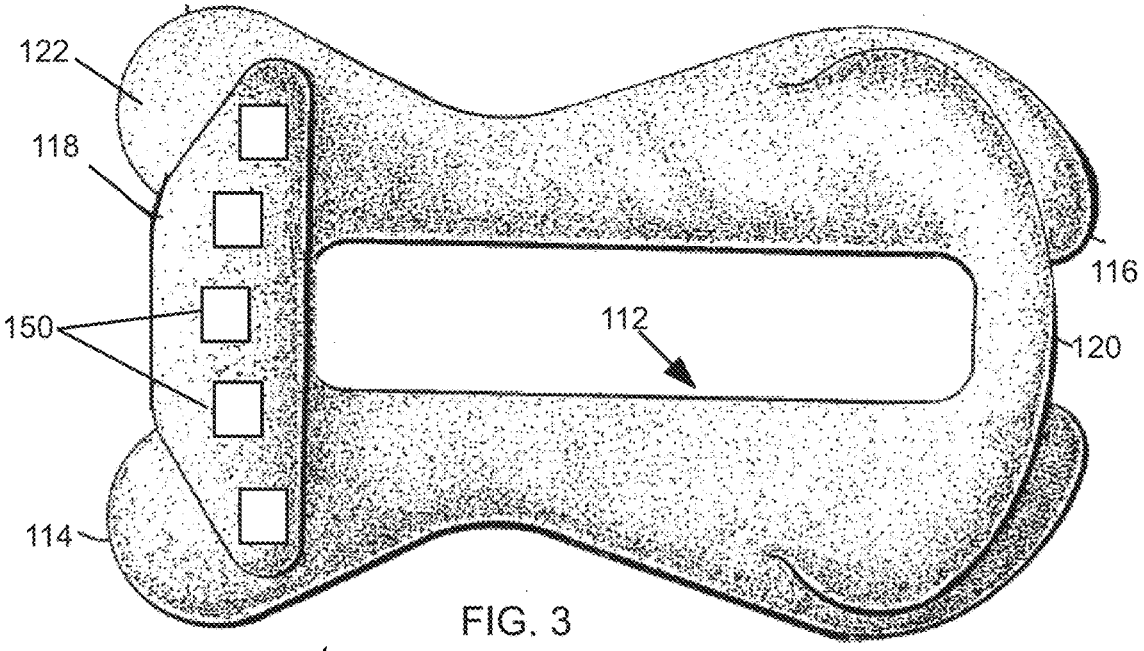
FIG. 3 is a top view of a second saddle tree useful with a second embodiment of the present disclosure.
Figure 4:
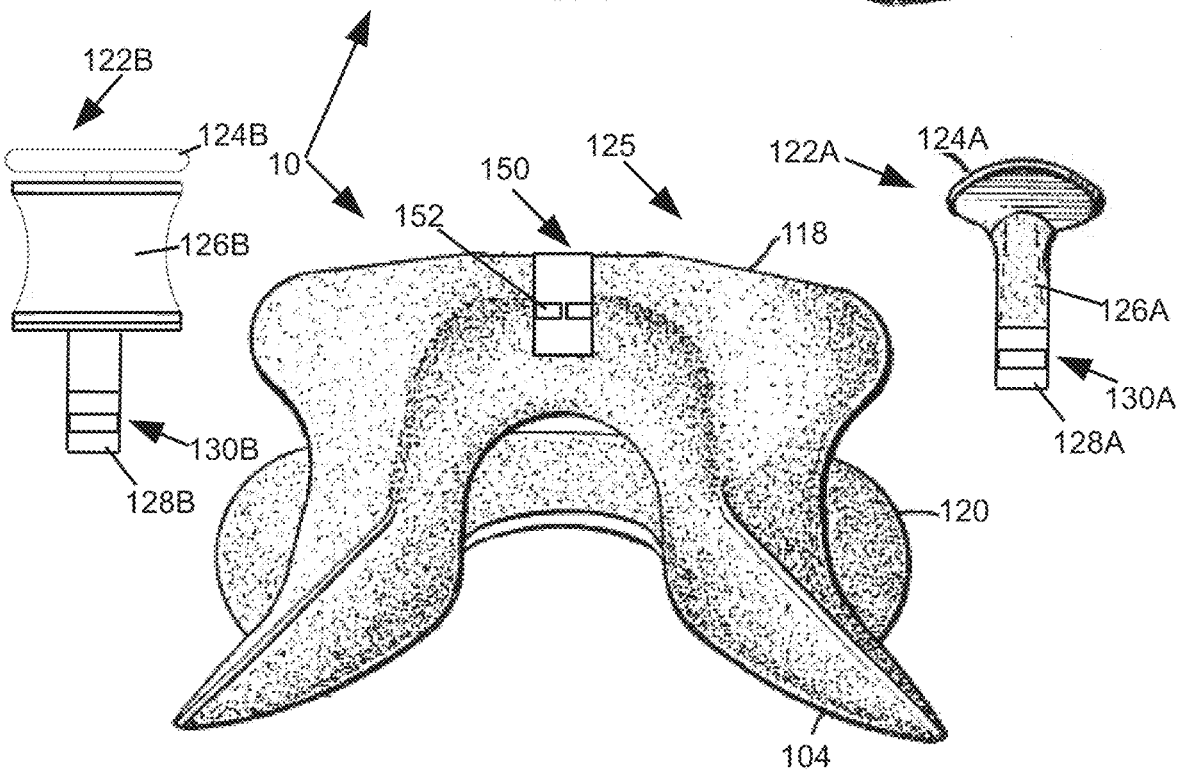
FIG. 4 is a front view of the saddle tree of FIG. 3, shown in a partial sectional view, along with a detachable saddle horn assembly, also depicted in a partial sectional view.

In other embodiments, the horn 122 may be releasably attached to an anchoring structure in the fork 118. As best depicted in FIG. 3, in such embodiments, the fork 118 or saddle tree 10 could include multiple recesses 150, such as one placed at the standard centered position and additional recesses moving outwards to the sides of the saddle. Each recess 150 could include structures for releasably attaching the removable horn 122A to the saddle and anchoring it therein. In the depicted embodiment, this is best shown in FIG. 4, where the cutaway view of the single depicted recess 150 shows retractable anchor bars or rods 152 that are inserted into the anchoring recess or slot 130A (depicted in cutaway) on the lower or anchoring portion 128A of the stem 126A of the detachable saddle horn 122A. In one exemplary embodiment, the anchoring recess or slot 130A may be formed as a bore passing through the lower or anchoring portion 128A of the stem 126A. As depicted, the detachable saddle horn 122A has an enlarged head 124A, similar to that depicted in FIG. 1.

The horn 122A may be detached from a recess 150 by retracting bars 152 and lifting the horn 122A upwards and reattached by reversing the process. It will be appreciated the bars 152 may be retracted by any suitable mechanism. Further, it will be appreciated though two bars from the latitudinal sides are depicted, that any number of bars or suitable alternative anchoring mechanisms may be used. For example, a single bar inserted into a hole in the front of the fork which is then retained in place by threading into grooves in the slot 130A or by a retaining pin could be used.

It will be appreciated that saddle horns 122A having different profiles and features the may be secured to the saddle tree 10 may be used. The flexibility of different horns and different placements, can allow a saddle to be reconfigured as needed for various uses. This can also allow different profile saddle horns 122 to be used with a single saddle or for the replacement or repair of a worn saddle horn 122. For example, a roping horn with a rubber coated stem for "gripping" a dallied rope and an enlarged head could be used for certain applications, while a horn designed for use as a handle could be used for other applications. For example, horn assembly 122B depicts a horn with a replaceable/repositionable dallying sleeve installed on the stem 126B portion above the lower anchoring portion 128B. While some dallying horns having this type replaceable sleeve are disclosed in U.S. Pat. No. 8,397,477, which is incorporated by reference herein in its entirety, such horns typically have a removable cap. By contrast, the present disclosure allows for the removable sleeve to be replaced from the bottom of a detached horn assembly and the cap or head 124B may be unitary structure with the stem 126B to allow for greater strength in use.

Other types of horns may allow for varying designs and colors as fashion accessories, or for additional utilities, such as a work light which attaches as a "horn" to a recess 150, or even for a child seat that attaches to one or more recesses 150. Additionally, with embodiments having multiple recesses 150, users desiring different horn placements may detach and reattach horns at the desired positions.

Figure 5:
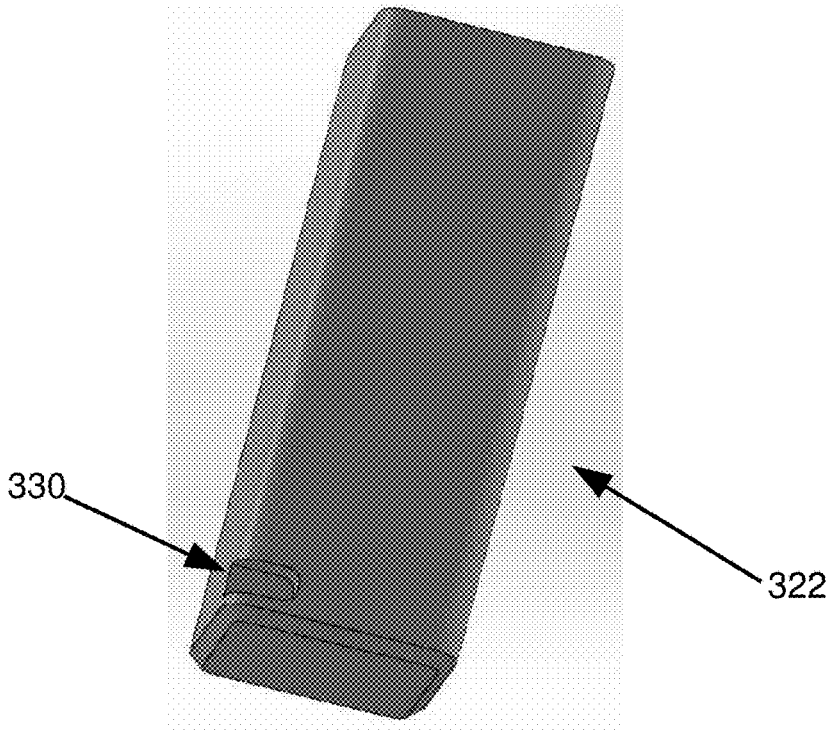
FIG. 5 depicts another embodiment of a saddle horn post useful in embodiments of the present disclosure.
Figure 6:
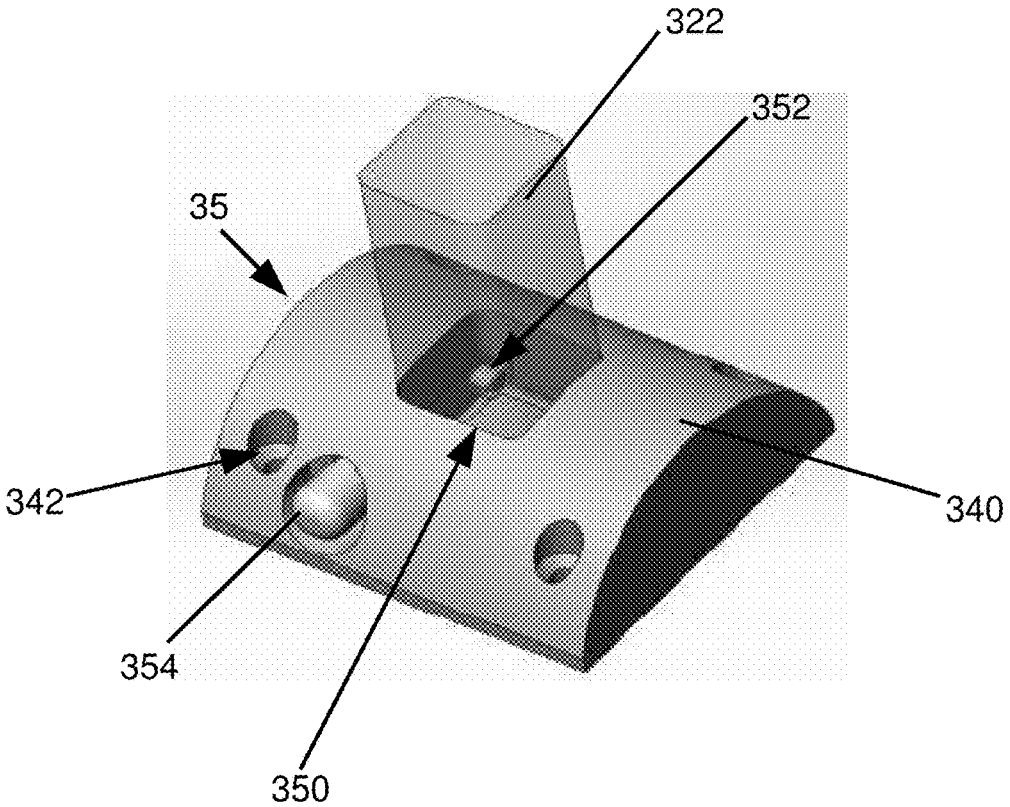
FIG. 6 depicts a locking recess assembly for use with the saddle horn post of FIG. 5.

Turning to FIGS. 5 and 6, a saddle horn post 322 and a locking recess assembly 35 useful with embodiments of the present disclosure are depicted. The locking recess assembly, may be formed as a body 340 containing a recess 350, which can be attached to a saddle or saddle tree to provide the recesses 150 discussed previously herein.

Horn post 322 may include a slot 330 formed in the lower portion of a body thereof for locking in recess 350 and may be formed as an elongate columnar member. As depicted, the post 322 may have a generally rectangular cross-sectional shape, but it will be appreciated that other shapes included rounded posts or irregular or polygonal posts could be used. The slot 330 may be formed as a recess in a side surface, rather than as a hole through the post 322, where appropriate to facilitate construction or alignment of the horn. As discussed above, different types of horns may be formed by using different features or profiles attached to or formed on or in the horn post 322.

Recess body 340 may include attachment points, such as screw or bolt holes 342 allowing the body 340 to be secured to a saddle tree or saddle. This can allow the attachment of the body 30 to existing saddles to provide a removeable horn feature to an existing saddle.

Recess body, 340 contains a recess 350 that is configured for insertion of the lower end of the horn post 322 there in, by closely corresponding to the horn side wall shape. The recess 350 may include structures for releasably attaching the removable horn post 322 to the saddle and anchoring it therein. In the depicted embodiment, this is best shown in FIG. 6, where the phantom view of the insert horn post 322 shows retractable anchor bar or rod 352 that is inserted into the anchoring recess 330 on the lower or anchoring portion detachable saddle horn post or stem 322. As depicted, a release button 354 may be used to extend or retract the anchor bar 352 to allow the post 322 to be inserted or removed.

In the depicted embodiment, the button 354 and anchor 352 may be connected by a bar or other linkage contained in the body 340, such that depressing the button retracts the bar 352 from the recess 350 allowing the stem 322 to be removed. A spring (not shown) may urge the button and bar forwards, to retain the bar 322 in the anchoring recess 330. The bar 322 may have a curved insertion end, allowing it to retract as the stem 322 is inserted without a separate depression of the button 354. It will be appreciated the bars 352 may be retracted by any suitable mechanism and that a return spring, or other necessary structures for such mechanism can be retained in the recess body 340. For example, rather than a button 354, a handle (such as a ring on an eternal end of the anchor bar outside the body 340) which is pulled to withdraw the anchor from the anchoring recess 350 could be used with a spring that urges the anchor 322 into the recess 350 to retain the stem 322 in place. Similarly, the anchor could be one or more ball bearings that are rotatably mounted in retaining collets on the side of the recess and resiliently depressible therein, to allow a stem 322 with counterpart anchoring recess shaped to receive the exposed portions of the bearings to be inserted and removed in a vertical motion, but retained during any force applied in a sideways direction.

Recess body 340, horn post 322, and anchor bar 352 may all be constructed from suitably strong materials to allow them to function and withstand forces generated during use. One suitable material may be machined aluminum. Suitable steel alloys may also be used.

Saddle trees 10 in accordance with the present disclosure may be covered with leather or other suitable materials to create finished saddles for use as is known in the art.

While this disclosure has been described using certain embodiments, it can be further modified while keeping within its spirit and scope. This application is therefore intended to cover any variations, uses, or adaptations of the disclosure using its general principles. Further, this application is intended to cover such departures from the present disclosure as come within known or customary practices in the art to which it pertains and which fall within the limits of the appended claims.

What is claimed is:

1. A specialized saddle system comprising:

a saddle for riding, the saddle including a saddle fork;

a plurality of horn mounting recesses extending into the saddle fork from an upper surface of the fork;

each horn mounting recess having a first retention locking member disposed therein; and at least a first detachable saddle horn, the at least first detachable saddle horn comprising a columnar stem portion and a head portion, wherein the columnar stem portion includes a counterpart locking structure that receives at least a portion of the first retention locking member therein when the columnar stem portion of the detachable saddle horn is inserted into a selected horn mounting recess of the plurality of horn mounting recesses to thereby retain the detachable saddle horn in the selected horn mounting recess.

2. The specialized saddle system of claim 1, wherein one horn mounting recess of the plurality of horn mounting recesses is disposed in the saddle fork at a centered position and at least one additional member of the plurality of horn mounting recesses is disposed in the saddle fork at a position closer to a left side of the saddle.

3. The specialized saddle system of claim 2, wherein at least a second member of the plurality of horn mounting recesses is disposed in the saddle fork at a position closer to a right side of the saddle than the horn mounting recess disposed at the centered position.

4. The specialized saddle system of claim 1, wherein one horn mounting recess of the plurality of horn mounting recesses is disposed on the saddle fork at a centered position and at least one additional member of the plurality of horn mounting recesses is disposed in the saddle fork at positions closer to a right side of the saddle.

5. The specialized saddle system of claim 1, wherein the counterpart locking structure on the stem portion of the at least a first detachable saddle horn comprises at least one recess for receiving the first retention locking member.

6. The specialized saddle system of claim 5, wherein the least one recess for receiving the first retention locking member comprises a bore passing through a body of the stem portion.

7. The specialized saddle system of claim 5, wherein the first retention locking member comprises a movable anchor bar disposed in the at least one mounting recess.

8. The specialized saddle system of claim 5, wherein the first retention locking member comprises a movable anchor bar which is extended or retracted by placement through a latitudinal hole in the saddle fork.

9. The specialized saddle system of claim 5, wherein the at least one mounting recess disposed in the fork further comprises a locking recess assembly which comprises a recess body containing a recess and the first retention locking member.

10. The specialized saddle system of claim 9, wherein the first retention locking member is actuated by a release button accessible on the recess body.

11. The specialized saddle system of claim 5, wherein the at least one mounting recess has sidewalls that closely correspond to a sidewall of the stem portion of the at least first detachable saddle horn.

12. The specialized saddle system of claim 1, wherein the stem portion of the at least first detachable saddle horn comprises an elongate columnar member with a rectangular cross-sectional shape.

13. The specialized saddle system of claim 1, wherein the head portion of the at least first detachable saddle horn comprises an enlarged cap for retaining a rope or a handle for use in mounting.

14. A detachable horn mounting system for a specialized saddle, comprising:

a a plurality of anchor bodies for attachment to a saddle fork, a plurality of horn mounting recesses embedded in the fork and accessible at an upper surface of the saddle fork for use, each horn mounting recess of the plurality of horn mounting recesses corresponding to an anchor body of the plurality of anchor bodies for attachment to a saddle fork;

a retention locking member disposed in each horn mounting recess of the plurality of horn mounting recesses; and at least a first detachable saddle horn, the at least first detachable saddle horn comprising a columnar stem portion and a head portion, wherein the columnar stem portion includes a counterpart locking structure for interacting with the retention locking member when the detachable saddle horn is inserted into a selected horn mounting recess of the plurality of horn mounting recesses from the upper surface of the saddle fork to retain the horn in the selected horn mounting recess in the saddle fork.

15. The system of claim 14, wherein each horn mounting recess of the plurality of horn mounting recesses has sidewalls that closely correspond to a sidewall of the stem portion of the at least first detachable saddle horn.

16. The system of claim 14, wherein the counterpart locking structure for receiving the retention locking member comprises a bore passing through a body of the stem portion.

17. The system of claim 14, wherein the first retention locking member comprises a movable anchor bar.

18. The system of claim 17, wherein the retention locking member is actuated by a release button accessible on the anchor body associated with the respective horn mounting recess of the plurality of horn mounting recesses.

* * * * *